United States Patent [19]

Miyafuji et al.

[11] Patent Number: 4,990,309

[45] Date of Patent: Feb. 5, 1991

[54] HIGH STRENGTH COPPER-NICKEL-TIN-ZINC-ALUMINUM ALLOY OF EXCELLENT BENDING PROCESSABILITY

[75] Inventors: Motohisa Miyafuji; Riichi Tsuno; Tatsuya Kinoshita, all of Shimonoseki; Hitoshi Tanaka, Kitakyushu, all of Japan

[73] Assignee: Kabushiki Kaisha Kobe Seiko Sho, Kobe, Japan

[21] Appl. No.: 375,936

[22] Filed: Jul. 6, 1989

[30] Foreign Application Priority Data

Sep. 16, 1988 [JP] Japan ..... 63-231799

[51] Int. Cl.[5] ..... C22C 9/06; C22C 9/01; C22C 9/04

[52] U.S. Cl. ..... 420/471; 420/473; 148/433

[58] Field of Search ..... 420/471, 473; 148/433

*Primary Examiner*—R Dean
*Assistant Examiner*—Margery S. Phipps
*Attorney, Agent, or Firm*—Oblon, Spivak, McClelland, Maier & Neustadt

[57] ABSTRACT

A high strength copper alloy of excellent bending processability containing Ni: 5–20 wt %, Sn: 0.5–3 wt %, Al: 0.5–5 wt %, Mg: 0.001–0.05 wt %, Cr: 0.001–0.1 wt %, Zn: 0.05–5 wt %, the balance of Cu and inevitable impurities, and having a tensile strength of from 80 to 120 kgf/mm$^2$. Up to 0.2 wt % of one or more of Fe,Mn-,Ti,Zr,P,In,Ta and Co can be added without a deleterious effect. The alloy is non-toxic and economical, as well as shows tensile strength and elongation at least comparable with beryllium-copper alloy and has excellent solderability and solder-resistant and heat resistant peelability. The alloy can be used suitably as materials for electric terminals, connectors, etc.

2 Claims, No Drawings

HIGH STRENGTH COPPER-NICKEL-TIN-ZINC-ALUMINUM ALLOY OF EXCELLENT BENDING PROCESSABILITY

BACKGROUND OF THE INVENTION

1. Field of the Invention

The present invention concerns a high strength copper alloy of excellent bending processability. More specifically, it relates to a high strength copper alloy of excellent bending processability that is suitable for use in terminals, connectors, etc. used in electric and electronic equipment of air crafts and large computers, etc.

2. Description of the Prior Art

Generally, extremely high reliability is demanded for various properties of spring material for terminals, connectors, etc. used for electric and electronic equipment in aircrafts, large computers, etc. In particular, along with a recent trend of reduction in the size of electric and electronic equipment, it has been required to reduce the thickness of spring material used for such equipments. In order to compensate for the reduction in reliability caused by the reduction in the thickness, in view of the strength, more strength has now been demanded for the spring material (tensile strength of not less than 80 kgf/mm$^2$).

It is known that beryllium-copper (Be-Cu) is a spring material having such high strength. Beryllium-copper having high tensile strength of about 100 kgf/mm$^2$ and satisfactory bending processability is used as reliable material.

However, since beryllium and beryllium oxide are toxic to human bodies, various protection measures have to be taken when producing terminals, connectors, etc. made of beryllium-copper. Further, since beryllium is expensive, products made of beryllium-copper are also expensive. Further, the beryllium-copper involves a problem that solderability is not satisfactory.

On the other hand, high strength copper alloys which are safe and sanitary to human bodies and are comparable with beryllium-copper, C72700 Cu-9wt%Ni-6wt%Sn) and, Cu-4wt%Ti, etc. are known. All of these alloys have tensile strength of not less than 100 kgf/mm$^2$. However, since the elongation property is lower as compared with that of beryllium-copper, cracks develop upon bending working. That is, since the bending processability is not satisfactory, they have not yet been used entirely as a substitute for beryllium-copper.

SUMMARY OF THE INVENTION

The object of the present invention is to provide a high strength copper alloy of excellent bending processability which is safe, sanitary, and economical, which has a tensile strength of 80 to 120 kgf/mm$^2$. Another object is to provide a copper alloy with bending processability comparable with or superior to that of the beryllium-copper and, further, satisfactory solderability.

The foregoing object of the present invention can be attained by a high strength copper alloy of excellent bending processability, containing Ni:5–20 wt%, Sn:0.5–3 wt%, Al:0.5–5 wt%, Mg:0.001–0.05 wt%, Cr:0.001–0.1 wt%, Zn:0.05–5 wt%, and the balance of Cu and inevitable impurities, and having a tensile strength of from 80 to 120 kgf/mm$^2$.

DETAILED DESCRIPTION OF THE PRESENT INVENTION

The high strength copper alloy according to the present invention is to specifically explained.

(Reason for Definition of Ingredients)

Ni is an essential element for improving the tensile strength and elongation property. If the content is not greater than 5 wt%, such effects become insufficient. On the other hand, if the content exceeds 20 wt%, it results in a problem of worsening hot processability. Accordingly, the Ni content is defined as 5–20 wt%.

Sn is an element for improving the tensile strength, elongation and spring property. If the content is not greater than 0.5 wt%, the effect is insufficient. On the other hand, if the content exceeds 3 wt %, hot processing becomes difficult. Accordingly, the Sn content is defined as 0.5–3 wt%.

Al is an element for improving the tensile strength and the elongation property. If the content is not greater than 0.5 wt%, the effect is insufficient. On the other hand, if the content exceeds 5 wt%, the solderability is worsened. Accordingly, the Al content is defined as 0.5–5 wt%.

Mg is an element used for setting S inevitably intruding upon melting and casting in the matrix in the form of MgS which is a stable compound with Mg, thereby improving the hot processability. If the content is not greater than 0.001 wt%, the effect is insufficient. On the other hand, if the content exceeds 0.05 wt%, the fluidity of the molten alloy deteriorates. Accordingly, the Mg content is defined as 0.001–0.05 wt%.

Cr is an element for strengthening the grain boundary of cast ingot thereby improving hot processability. If the content is not greater than 0.01 wt%, the effect is insufficient. On the other hand, if the content exceeds 0.1 wt%, the molten alloy is oxidized to deteriorate the castability. Accordingly, the Cr content is defined as 0.001–0.1 wt%.

Zn is an alloy remarkably improving the heat resistant peelability of tin or tin alloy plating from solder. If the content is not greater than 0.05 wt%, the effect is insufficient. On the other hand, if the content exceeds 5 wt%, the solderability is deteriorated. Accordingly, the Zn content is defined as 0.05–5 wt%.

Further, if one or more of Fe, Mn, Ti, Zr, P, In, B, Ta and Co is contained up to 0.2 wt% in addition to the above-mentioned ingredients and Cu, it does not worsen the property of the high strength copper alloy according to the present invention. Accordingly, incorporation of such elements within the above-mentioned range is permissible.

The high strength copper alloy according to the present invention can be made to final plate products of desired thickness, for example, by applying hot rolling to cast ingots, applying solid-solubilization at a temperature higher than 800° C. and, thereafter, conducting cold rolling and final cold annealing.

The high strength copper alloy according to the present invention is used generally as spring material and it can suitably be used as high performance springs, springs for relays, springs for electric equipment, microswitches, diaphragms, bellows, watch gears, fuse clips, connectors, receptacles, relays, various kinds of terminals, etc. It is particularly useful in connectors or terminals for electric equipment in aircrafts, large computers, etc. for which high reliability is required.

DESCRIPTION OF THE PREFERRED EMBODIMENTS

The high strength steel alloy according to the present invention is to be explained specifically referring to preferred embodiments.

Copper alloys No. 1–No. 12 having chemical ingredients each in a ratio as shown in Table 1 were, respectively, melted in an electric furnace while being covered with charcoal in an atmosphere and, thereafter, cast into ingots each of 50 mm thickness, 80 mm width and 180 mm length. After scraping the surface and the rear face of the cast ingot, hot rolling was applied at a temperature of 880° C. resulting in a 10 mm thickness, applied with hot rolling and then quenched in water.

In this case, since Comparative Alloy No. 8 showed remarkable Sn segreation and developed hot cracking, it was excluded from the subsequent specimen preparation.

Further, since Comparative Alloy No. 9 containing Mg and Comparative Alloy No. 10 not containing Cr developed hot cracking, they were excluded from the subsequent specimen preparation.

Then, after pickling and removing oxide scales from the hot rolled materials quenched in water, they were finished each into 30 mm thickness by cold rolling, annealed at a temperature of 700° C. for two hours in an electric furnace and oxide scales removed by means of pickling and polishing.

Such sheet materials were processed by cold rolling each into a thickness of 0.40 mm, applied with cold working, immersed in a salt bath furnace conditioned to 900° C., maintained for 20 sec. and then taken out and directly quenched in water. Successively, after pickling and polishing, sheet materials each of final sheet thickness of 0.25 mm were prepared by cold rolling and then applied with final low temperature annealing at a temperature of 500° C. for 2 hours.

Using the sheet materials as described above, tests shown below were carried out.

A tensile test was conducted by using a test specimen according to JIS No. 13 B cut-out in parallel with the rolling direction.

Hardness was measured by a micro Vickers hardness tester under a load of 500 g.

Spring limit value ($Kb_{0.1}$) was measured by using a thin sheet spring tester APT manufactured by Akashi Seisakusho.

For the electrical conductivity, electric resistance was measured by means of the double bridge method using a specimen of 10 mm width and 300 mm length and calculated by means of the average cross sectional method.

For the bending processability, 90° bending was applied in an actual press at R+0.25 mm (bending ratio R/t+1.0, in which R is bending radius and, t is plate thickness), with the bending line being in perpendicular to the rolling direction, the bent portion was observed by a 20× magnifier and the bending processability was evaluated depending on the start and propagation of cracks.

Solderability was evaluated by observing the condition of the surface after soldering in a soldering bath of Sn60-Pb40 at a temperature of 230° C. The heat resistant solder peelability was evaluated for a soldered specimen after heating at a temperature of 150° C. for 500 hours by re-bending it with 180° at 2 mm R and investigating the close bondability of soldering.

Results of the foregoing tests are shown in Table 2.

As apparent from Table 2, Alloys No. 1–No. 4 according to the present invention were excellent for the balance between the tensile strength and the elongation, had higher spring limit value and were satisfactory for all of the characteristics including bending processability, solderability and heat resistant solder peelability as compared with Comparative Alloys No. –No. 12.

On the contrary, Comparative alloy No. 5 containing Sn of not greater than 0.5 wt%, showed poor balance between the tensile strength and the elongation and cracked upon bending working by 90°.

Similarly, Comparative alloy No. 6 containing not greater than 0.5 wt% of Al showed lower tensile strength and less elongation as compared with the alloys of the present invention. Accordingly, it cracked bending working by 90°. Further, Comparative Alloy No. 7 not containing Zn involved a problem in the heat-resistant solder peelability.

Comparative Alloy No. 11 of beryllium-copper was not satisfactory in view of the solderability.

Further, Comparative Alloy No. 12 was inferior in the elongation property although having tensile strength as comparable with that of Alloys No. 1–4 according to the present invention. Therefore, it cracked in bending working by 90°.

As has been apparent from the foregoing explanations, the present invention can provide the following advantageous effects, that is, it can provide:

(1) a high strength copper alloy which is safe and sanitary, as well as economical;

(2) a high strength copper alloy having tensile strength and elongation property at least comparable with thereof beryllium-copper.

(3) a high strength copper alloy of more excellent solderability, and solder-resistant and heat-resistant peelability as compared with those of beryllium-copper.

Accordingly, the high strength copper alloy of the present invention can be used suitably as material for terminals, connectors, etc. for electric and electronic equipments in aircrafts, large computers, etc. for which high reliability is required.

TABLE 1

| | | Chemical ingredient (wt %) | | | | | | |
|---|---|---|---|---|---|---|---|---|
| | No. | Ni | Sn | Al | Mg | Cr | Zn | Cu |
| Alloy of the invention | 1 | 15.0 | 1.0 | 2.0 | 0.005 | 0.006 | 0.30 | Balance |
| | 2 | 17.5 | 0.8 | 2.1 | 0.004 | 0.005 | 0.31 | Balance |
| | 3 | 12.3 | 1.1 | 1.9 | 0.004 | 0.004 | 0.30 | Balance |
| | 4 | 9.3 | 1.2 | 2.2 | 0.005 | 0.005 | 0.30 | Balance |
| Comparative alloy | 5 | 15.0 | 0.4 | 2.0 | 0.004 | 0.005 | 0.30 | Balance |
| | 6 | 15.0 | 1.0 | 0.3 | 0.005 | 0.005 | 0.30 | Balance |
| | 7 | 15.0 | 1.0 | 2.0 | 0.005 | 0.006 | 0 | Balance |
| | 8 | 15.0 | 3.9 | 2.0 | 0.004 | 0.005 | 0.30 | Balance |
| | 9 | 15.0 | 1.0 | 2.0 | — | 0.005 | 0.30 | Balance |
| | 10 | 15.0 | 1.0 | 2.0 | 0.005 | — | 0.30 | Balance |
| | 11 | Beryllium-copper (C17000) | | (Cu-1.70 wt % Be-0.1 wt % Co) | | | Commercial products | |
| | 12 | C72700 | | (Cu-9 wt % Ni-6 wt % Sn) | | | Commercial products | |

TABLE 2

| No. | Tensile strength kgf/mm$^2$ | Elongation % | Hardness Hv500gf | Spring limit value $kb_{0.1}$ kgf/mm$^2$ | Conductivity % IACS | Bending processability R/t = 1.0 | Solderability | Heat resistant solder peelability |
|---|---|---|---|---|---|---|---|---|
| 1 | 103.8 | 15.3 | 323 | 80.9 | 12.9 | good | good | good |
| 2 | 108.2 | 15.5 | 327 | 85.3 | 12.0 | good | good | good |
| 3 | 100.3 | 17.3 | 320 | 79.6 | 13.4 | good | good | good |
| 4 | 98.5 | 18.6 | 317 | 78.2 | 14.8 | good | good | good |
| 5 | 98.6 | 10.3 | 316 | 60.3 | 13.2 | crack developed | good | good |
| 6 | 95.9 | 13.2 | 313 | 69.3 | 13.3 | crack developed | good | good |
| 7 | 103.2 | 15.4 | 321 | 79.8 | 12.3 | good | good | peeled |
| 8 | | | | cracked upon hot rolling | | | | |
| 9 | | | | cracked upon hot rolling | | | | |
| 10 | | | | cracked upon hot rolling | | | | |
| 11 | 103.5 | 14.9 | 322 | 80.8 | 19.6 | good | poor | . . . |
| 12 | 103.2 | 7.6 | 322 | 75.6 | 11.8 | good | poor | . . . |

What is claimed is:

1. A high strength copper alloy of excellent bending processability consisting of Ni:12.3–20 wt.%, Sn:0.5–1.2 wt.%, Al:0.5–5 wt.%, Mg:0.001–0.05 wt.%, Cr:0.001–0.1 wt.%, Zn:0.05–5 wt.%, the balance of Cu and inevitable impurities, and having a tensile strength of from 80 to 120 kgf/mm$^2$.

2. A high strength copper alloy of excellent bending processability consisting of NI:12.3–20 wt.%, Sn:0.5–1.2 wt.%, Al:0.5–5 wt.%, Mg:0.001–0.5 wt.%, Cr:0.001–0.1 wt.%, Zn:0.05–5 wt.% and up to 0.2 wt.% of one or more of Fe, Mn, Ti, Zr, P, In, Ta and Co, the balance of Cu and inevitable impurities, and having a tensile strength of from 80 to 120 kgf/mm$^2$.

* * * * *